United States Patent [19]

Hitt

[11] Patent Number: 4,779,053

[45] Date of Patent: Oct. 18, 1988

[54] SQUARE ROOT CIRCUIT WITH VOLTAGE-TIME MULTIPLIER

[75] Inventor: James J. Hitt, Willow Grove, Pa.

[73] Assignee: General Signal Corporation, Stamford, Conn.

[21] Appl. No.: 844,640

[22] Filed: Mar. 27, 1986

[51] Int. Cl.[4] ..... G06G 7/20; G06G 7/18

[52] U.S. Cl. ..... 328/144; 328/127; 328/151; 307/490

[58] Field of Search ..... 307/490, 491; 328/127, 328/151, 144; 364/814, 752, 842, 844, 11

[56] References Cited

U.S. PATENT DOCUMENTS 3,328,569 6/1967 Brewster ..... 328/144

3,916,180 10/1975 Turtle ..... 328/144

4,506,174 3/1985 Hitt ..... 328/144

4,616,332 10/1986 Robinson et al. ..... 364/814

*Primary Examiner*—Stanley D. Miller

*Assistant Examiner*—Timothy P. Callahan

*Attorney, Agent, or Firm*—William G. Miller, Jr.; Harold Huberfeld

[57] ABSTRACT

The square root insertion circuit of this invention has an operational amplifier circuit with a multiplying circuit of the voltage-time product type in its negative feedback path. The multiplying circuit is connected so that the time factor is proportional to the amplifier output signal and the voltage factor is also proportional to the amplifier output signal. Thus, the multiplying circuit acts as a squaring circuit to cause the output signal of the amplifier to be directly related to the square root of its input signal.

3 Claims, 4 Drawing Sheets

U8
SW2
-5V
R
R30
C5
R29
+5V
U5
VR1
R38
R39
R32
12
R28
OUT
R27
+5V
U4
R40
U9
R41
R26
U8
SW1
U8
SW3
C4
R22
C6
+5V
R21
R36
U7
+5V
R23
R24
C7
+5V
R19
Q5
TP3
R18
R16
R20
R17
R25
C8
-5V
-5V

SQUARE ROOT CIRCUIT WITH VOLTAGE-TIME MULTIPLIER

BACKGROUND OF THE INVENTION

This invention relates to a square root circuit such as those used with differential pressure transducers in the measurement of flow. The purpose of such a circuit is to provide a signal which is a directly related to flow when the primary measuring element produces a signal directly related to the square of the flow, such as would be derived from a differential pressure transducer.

In the prior art, analog circuits for this purpose have been constructed using high gain amplifiers with a squaring circuit inserted in the negative feedback path, as described in my U.S. Pat. No. 4,506,174, issued Mar. 19, 1985. That prior art circuit is a true insertion circuits in that it can be directly inserted into another circuit without changing the voltage levels or power requirements of that other circuit. It is desirable to provide a circuit of that type which would be cheaper to construct and which would provide improved conformity to the desired square root characteristic. It is therefore an object of this invention to provide an improved square root circuit which draws little power and which works at the typical voltage levels of circuits in which it might be inserted. It is also an object of this invention to provide such a circuit with sufficient quality to assure square root conformity to within ±0.1% from full range to 4% of input with good conformity to as low as 1% of input and to do so at a low cost while avoiding susceptibility to erratic operation in the region near zero.

SUMMARY OF THE INVENTION

The square root insertion circuit of this invention includes an operational amplifier circuit for driving a circuit output signal until a negative feedback signal fed to its input through a negative feedback path reaches equality with a variable circuit input signal. A multiplying circuit of the voltage-time product type provides a squaring circuit which forms the negative feedback path and causes the circuit output signal of the amplifier to be directly related to the square root of the circuit input signal.

The squaring circuit may desirably include a square wave oscillator circuit to provide timing for a measurement phase and a reset phase of the circuit during alternate half cycles of oscillation; a first ramp circuit operable to produce a first ramping voltage output which has a slope proportional to its input; a second ramp circuit operative during the measurement phase of the timing to provide a second ramping voltage output of predetermined fixed slope so that the magnitude of the second ramping voltage output is proportional to the time since the beginning of the measurement phase; and a comparator operative to compare the second ramping voltage output and the circuit output signal and to produce a change of voltage level at the comparator output when the output of the second ramp circuit has reached the level of the circuit output signal so that the time period, $t_a$, between the start of the measurement phase and the change of voltage level, is directly related to the magnitude of the circuit output signal. There is also included a first switching means operable to connect the input of the first ramp circuit to the output of the operational amplifier during the time period $t_a$ and to disconnect the first ramp circuit from the output of the operational amplifier in response to the change in voltage level at the comparator output, so that the first ramping circuit will produce an output which ramps only for the period $t_a$ and along a slope proportional to the magnitude of the circuit output signal. There is additionally provided a sample and hold circuit operable to connect a capacitor across the output of the first ramp circuit at the end of the period $t_a$ so that the capacitor will be charged to the peak value of the first ramping voltage. The capacitor is connected to the input of the operational amplifier so that the peak value of the output of the first ramp circuit is thereby sampled at the end of the time period $t_a$ and held on the capacitor as an input to the operational amplifier until the next measurement phase so that as the measurement phase is repeated during consecutive cycles of the oscillator the operational amplifier will force the circuit output signal to take that value which will cause the input to the operational amplifier from the capacitor of the sample and hold circuit to be equal and of opposite polarity to the circuit input signal, and therefore proportional to the square of the parameter being measured, whereby the circuit output signal is forced to take a value which is equal to the square root of the circuit input signal.

During the reset phase of the oscillator cycle the first and second ramp circuits are reset so that the outputs at the ramp circuits are returned to zero in preparation for the next measurement phase of the cycle.

Figure 1:
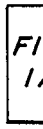
FIG. 1 shows the manner in which FIGS. 1a and 1b should be juxtaposed to illustrate the circuit of FIG. 1, which can be used to carry out this invention.

FIGS. *2a—2e* show the voltage levels at various parts of the circuit of FIG. 1 during operation.

Figure 3:
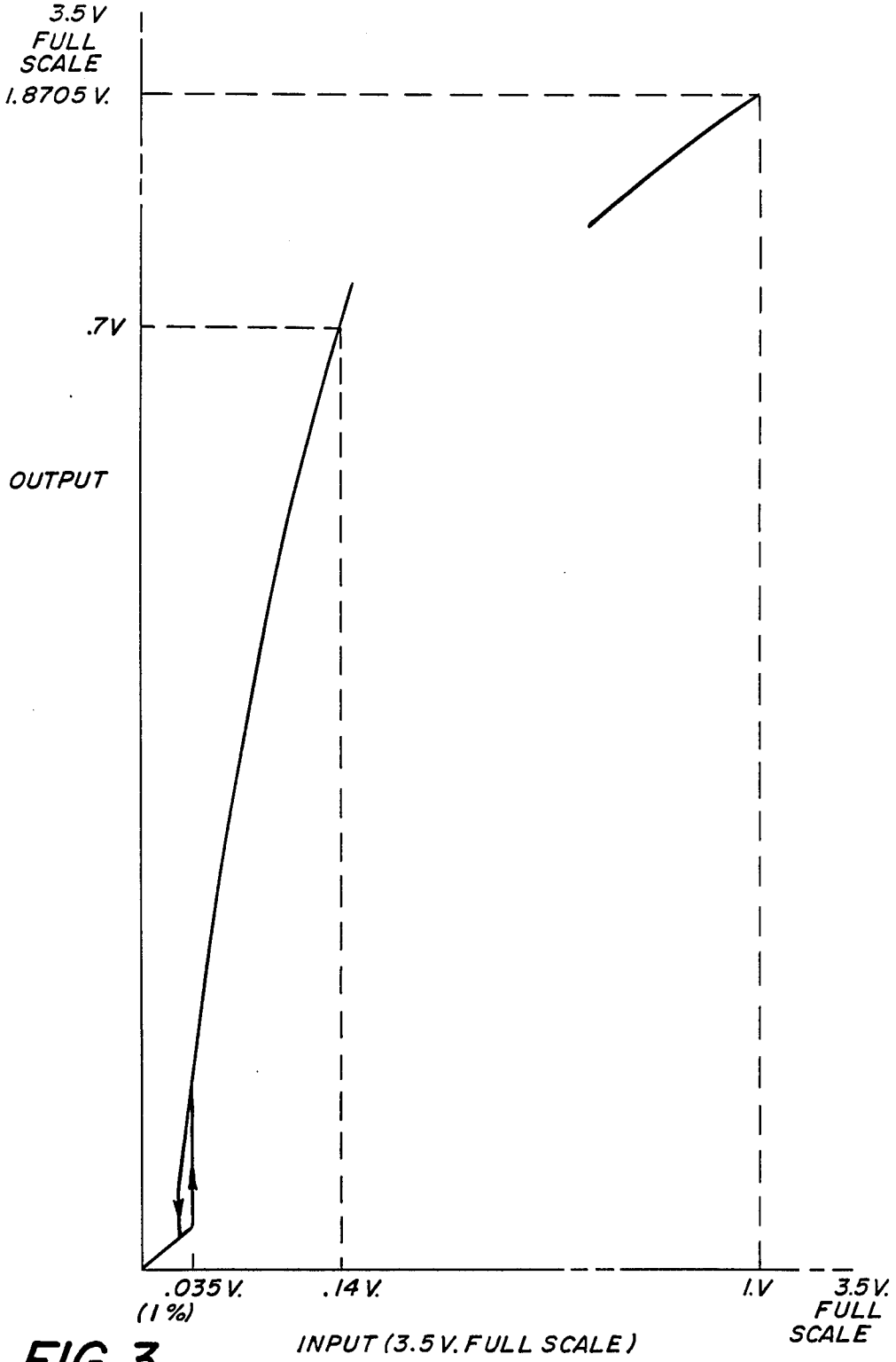

FIG. 3 shows a graphical representation of the characteristic of the circuit of FIG. 1.

DESCRIPTION OF THE PREFERRED EMBODIMENT

Figure 1A:
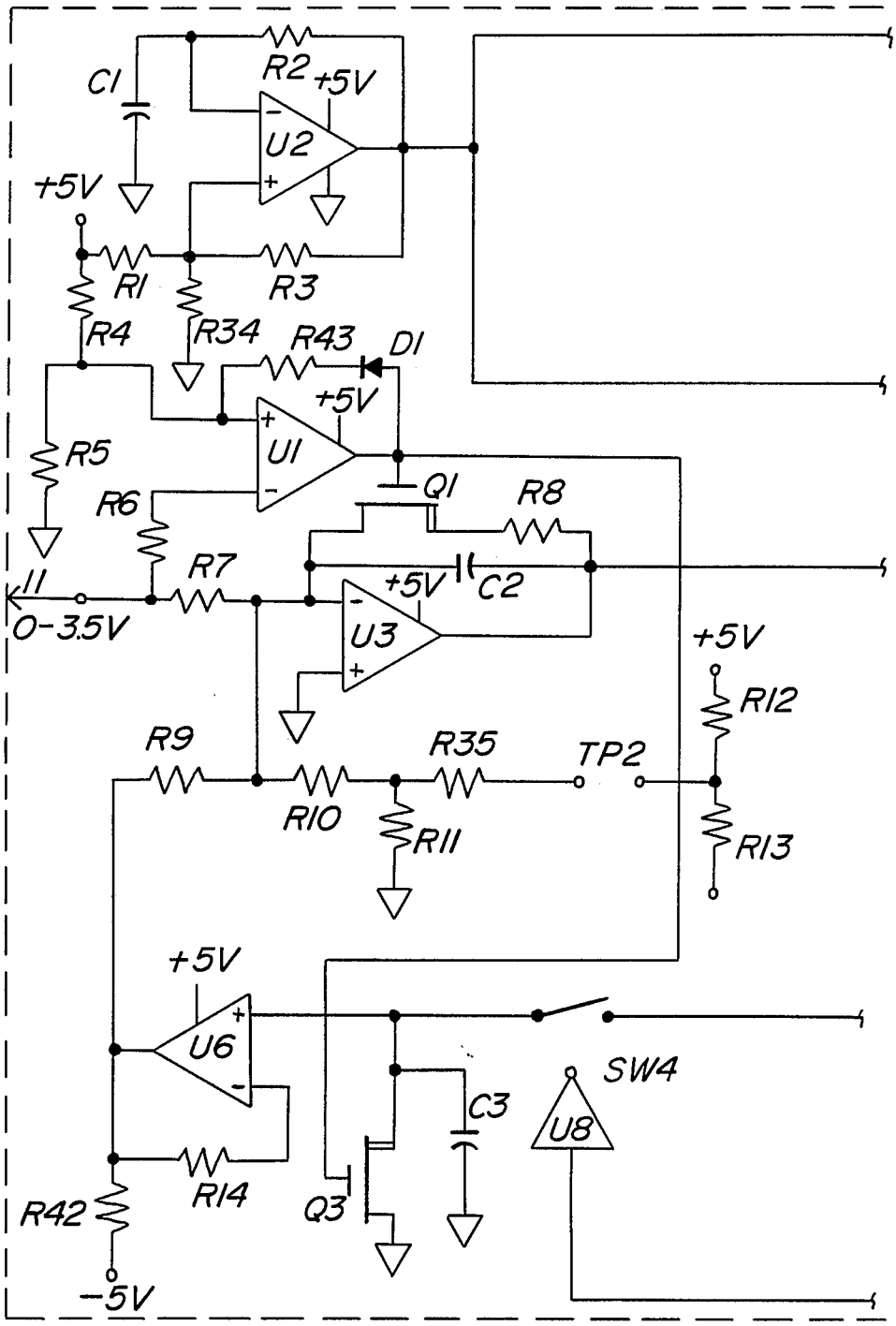

In FIG. 1A there is shown a terminal 11 for receiving a circuit input signal, $V_{in}$, which is a voltage level representing a value whose square root is to be determined. For example, the voltage level $V_{in}$ may be derived as the output of a differential pressure transducer, and may thus represent the square of the flow being measured by that transducer. Since a value representing the square of the flow is not as desirable a value to monitor as a value directly related to the flow, it is normally necessary to convert such squared values to a value directly representing the flow. Thus, it is desired to produce from the circuit input signal $V_{in}$ a circuit output signal $V_{out}$ which is the square root of the circuit input signal.

The voltage level $V_{in}$ is introduced as an input through summing resistor R7 to the inverting input of a high gain operational amplifier circuit which includes the amplifier U3, whose noninverting input is connected to ground. The other elements of the operational amplifier circuit include the stabilizing capacitor C2, which forms one negative feedback path for the amplifier and helps to prevent oscillations in the circuit; the feedback resistor R8, sometimes connected in shunt with capacitor C2 through a DMOS type FET Q1; as well as another summing resistor R9, connecting another negative feedback path, which will be explained subsequently.

Figure 1B:
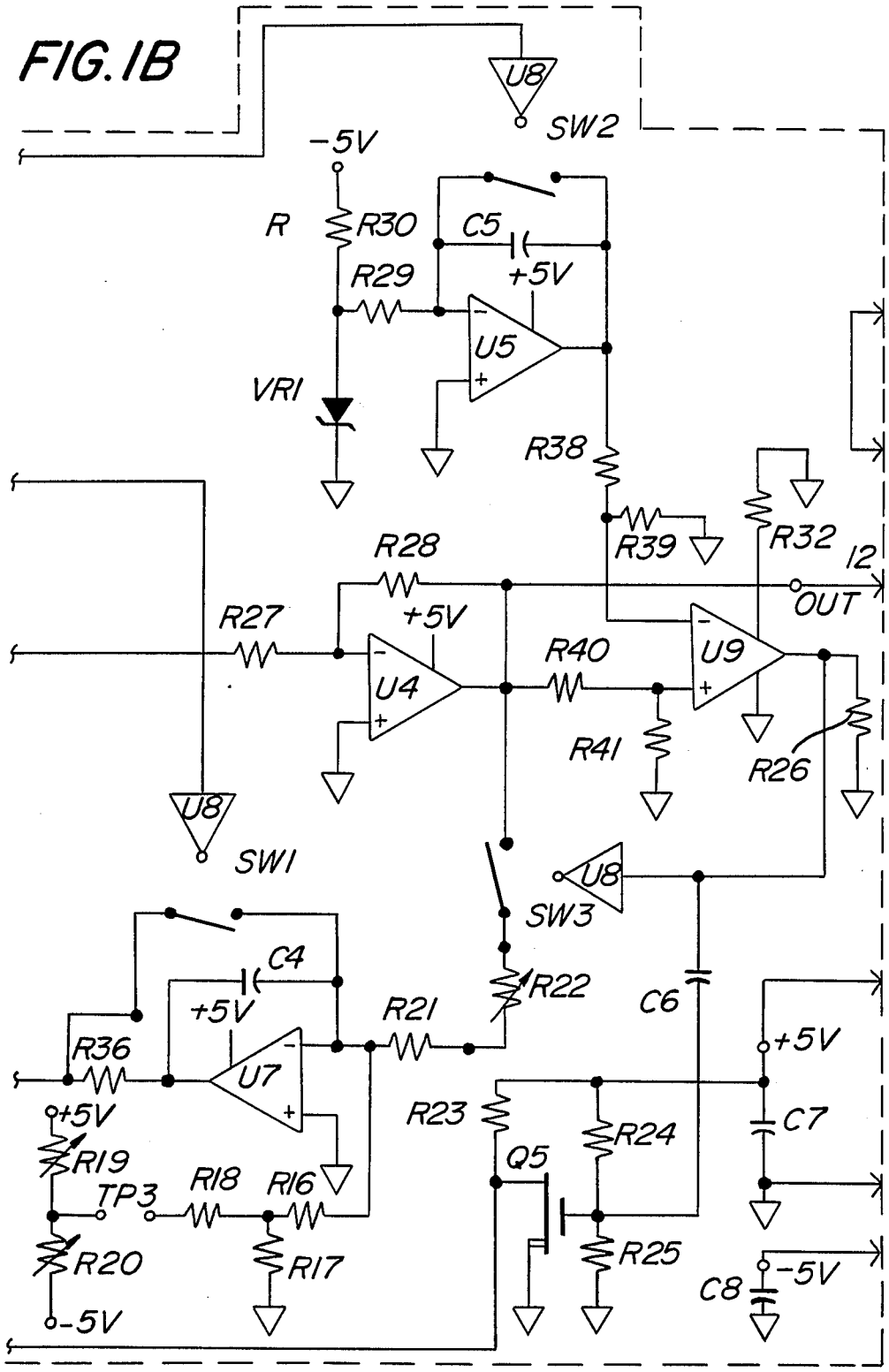

In FIG. 1B, the output of U3 is fed through resistor R27, which combines with resistor R28 coupled in negative feedback relationship to U4 to provide on the output of U4 a signal which is of the same value as the input to U4 but of opposite polarity. The resulting inverted signal is the circuit output signal and as such is fed to output terminal 12. That circuit output signal is also fed through R22 and R21 to a squaring circuit connected to the operational amplifier circuit U3 (FIG. 1A) through resistor R9 so that it is in negative feedback relationship to the operational amplifier circuit. Thus the squaring circuit may be considered to include the amplifiers U2, U5, U6, U7, and U9 and their associated circuitry which will be explained subsequently.

Figures 2A, 2B, 2C, 2D, 2E:
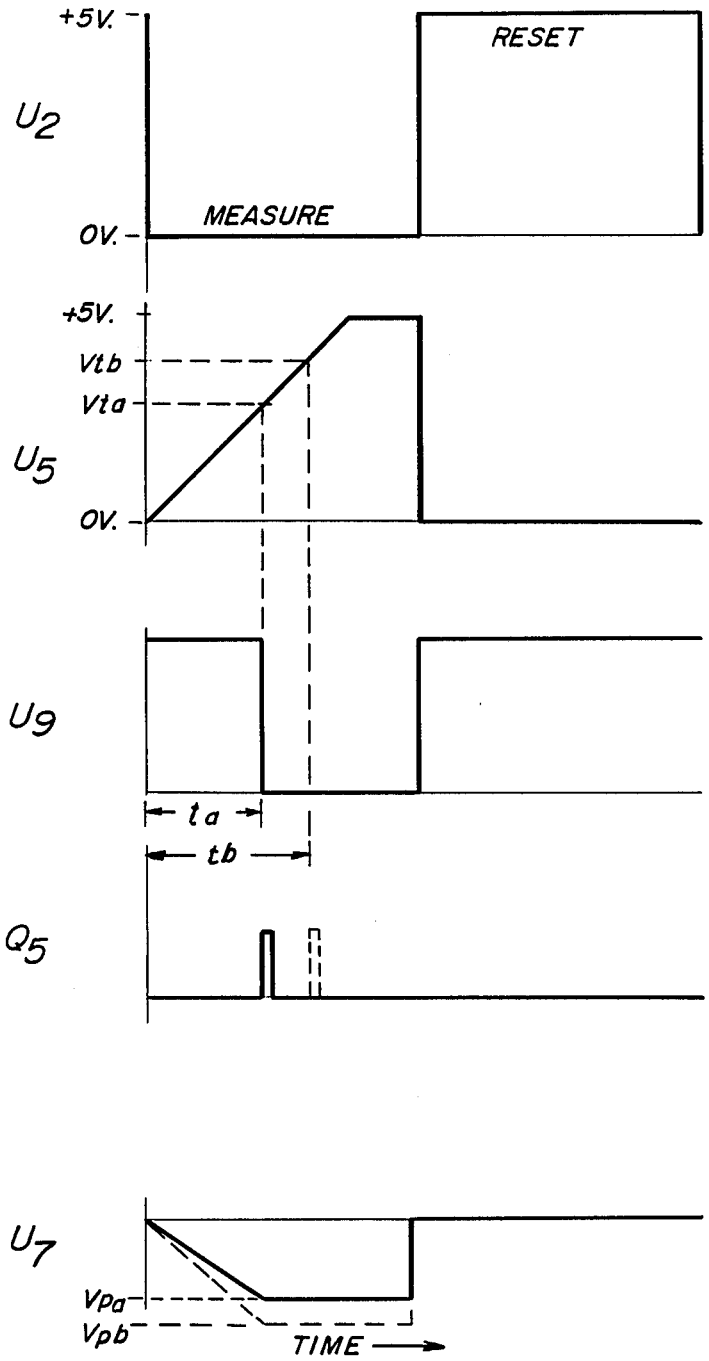

In order to provide the timing for the squaring circuit, there is provided a Schmitt trigger circuit, shown in FIG. 1A as including amplifier U2 and its associated circuitry, which will provide a square wave oscillating waveform at the output of amplifier U2. This waveform is shown in FIG. 2*a* where one half cycle, that at the zero voltage level, is identified as the measuring phase of the circuit and the other half cycle, that shown as having a +5 volt level, is identified as the reset phase. The elements of the Schmitt trigger circuit which work with the amplifier U2 include the capacitor C1, the negative feedback resistor R2, a positive feedback resistor R3, and a voltage divider made up of resistors R1 and R34. These resistors and the capacitor being sized to provide the desired frequency of oscillation. The output of the Schmitt trigger circuit is fed to two FET solid state switches shown symbolically in FIG. 1B as switches SW1 and SW2 which serve to cause the resetting of the two ramp circuits during the reset phase of the circuits cycle. These two switches are thus caused to close when the circuit is in its reset phase, that is when the output of U2 (FIG. 1A) is +5 v.

In FIG. 1B, one of the ramp circuits includes the amplifier U5 with its feedback capacitor C5 and a biasing circuit comprising R30 and diode VR1 connected in series between the −5 v. supply and ground so that the junction between those elements is connected through resistor R29 to the inverting input of amplifier U5. The voltage established by the biasing network and the value of resistor R29 and the value of capacitor C5 establish the fixed slope of the ramp voltage provided at the ouput of amplifier U5. That output is introduced as an input to the inverting input of amplifier U9 through a voltage dividing network comprising resistors R38 and R39.

The amplifier U9 and its associated circuitry provide a comparator for comparing the voltage level of the circuit output signal at terminal 12 with the output of amplifier U5, as divided by the dividing network. As will be seen from the drawing FIG. 1B, the output of inverter U4 is fed through the voltage divider comprising R40 and R41 to the noninverting input of an amplifier U9. Thus, when the divided voltage level of the ramp circuit of U5 equals the divided output of U4 the level of the output of U9 will be caused to drop from a +5 v. level to 0 v. level, as shown in FIG. 2*c*. The ramp output of amplifier U5 is illustrated by the waveform of FIG. 2*b*; and, as shown there, when the voltage level of the ramp reaches the level of the output of U4, shown as the voltage level $V_{ta}$ then the output of U9 is toggled to 0 v. As shown in FIG. 2*c*, the time period $t_a$ is the period between the beginning of the measuring phase and the toggling of U9. That period will be directly proportional to the voltage level of the circuit output signal on terminal 12.

Another ramping circuit is provided by amplifier U7 and its associated circuitry. As will be described, this ramp circuit has its input connected to the circuit output signal for a period proportional to the level of the circuit output signal so that the slope of the ramp is proportional to the circuit output signal and the time $t_a$ that the ramp is effective is proportional to the circuit output signal; therefore, the voltage level reached by the ramp is proportional to the square of the circuit output signal. This is accomplished by utilizing the togging of U9 to connect the circuit output signal to the input of U7. Thus a FET solid state switch, shown symbolically as switch SW3, which is normally closed, is opened in response to the toggling of the output of U9 to 0 v. after the the time period $t_a$. The switch SW3 remains open during the portion of the cycle in which U9 is at a 0 v. level and it is closed when the level of the output of U9 returns to +5 v. at the end of the measuring phase.

When the switch SW3 is closed the circuit output signal is fed through resistors R22 and R21 to the inverting input of amplifier U7. To provide the ramping output for U7 the capacitor C4 is connected in negative feedback circuit with U7. The adjustable resistors R19 and R20 are connected in series between the +5 v. and −5 v. supplies so as to provide an adjustable bias to the network consisting of resistors R16, R17 and R18. This bias is useful for adjusting the square root conformity of the circuit when the circuit input signal is within a range of 4% to 100% of full scale input. As is evident, the ramp circuit formed with U7 is reset by shorting out the combination of capacitor C4 and resistor R36 during the reset phase. The ramping of the output of U7 starts when the reset phase ends.

The output of the ramp circuit of U7 is fed through switch SW4 (FIG. 1A), which is shown symbolically to represent a FET solid state switching element, to capacitor C3 (FIG. 1A) which is charged to the peak voltage level of the output of U7 during that short switch closure time.

The timing of the closure for switch SW4 (FIG. 1A) is provided by capacitor C6, which is connected between the output of U9 and the junction between R24 and R25, which in conjunction with the supply of one side of R24 from +5 v. and with R25 connected to ground provide a biasing network for biasing the DMOS FET Q5 to a normally on state. When the gate voltage on Q5 goes negative in response to the change in level of the output of U9, at the end of time period $t_a$, Q5 is turned off and the drain of Q5 goes positive, as shown in FIG. 2*d*. This causes switch SW4 (FIG. 1A) to close so that capacitor C3 (FIG. 1A) charges during the short period of the pulse from Q5.

It will be evident from the above discussion that the output of the ramp circuit including U7, during the measurement phase, will follow the negative going ramp shown in FIG. 2*e* with the slope determined by the the voltage level of the circuit output signal until switch SW3 is opened, when the voltage level of the output of U7 has reached its peak $V_{pa}$, as shown in FIG. 2*e*. If the voltage of the circuit output signal changes to $V_{tb}$, as shown in FIG. 2b by the dotted lines, the time period $t_a$ lengthens to $t_b$ and the pulse output of Q5 is displaced in time so that not only is the slope of the ramp circuit of U7 steeper, but it is ramping for a longer time to provide a new peak voltage $V_{pb}$.

In FIG. 1A, the capacitor C3 is connected through the amplifier U6 and its associated circuitry to the summing resistor R9 to complete the negative feedback path for operational amplifier U3. The function of U6 is to prevent the capacitor from being loaded down by the input circuit of amplifier U3. As shown, the resistor R14 is in a negative feedback path with U6 and resistor R42 connects the output of U6 to the −5 v. supply. With the feedback circuit complete, it will be evident that the operational amplifier U3 will drive the circuit output signal to a value which will cause the feedback signal supplied to resistor R9 to equal the circuit input signal supplied to R7, and since the signal supplied to R9 is always the square of the circuit output signal then the circuit output signal will be the square root of the circuit input signal.

As has been described in my referenced patent, it is useful to convert the operational amplifier to a linear amplifier in the region near zero in order to make possible an easy adjustment of the zero output for a zero input. To accomplish this manner of operation, it is necessary in reference to FIG. 1A to use resistor R8 in shunt with capacitor C2 to make the circuit of U3 linear. This is accomplished by utilizing the amplifier U1 to close the switch represented by DMOS type FET Q1. As shown, the amplifier U1 has a positive feedback circuit including the resistor R43 and diode D1. The effect of this circuit is to cause the bias of the input line to the noninverting input of U1 to go up after U1 has switched to a positive level. This causes the hysteresis like curve shown in FIG. 3, which illustrates the characteristics of the present circuit by showing the changes in output as the input increases from zero to full scale.

Referring to FIG. 3 the linear region of the characteristic shown near zero, below 1% of full scale input, is provided in the circuit of FIG. 1A by the closing of Q1. At the same time the output of U1 also operates through Q3, another DMOS type FET, to short out the capacitor C3 in prevention of any input to U3 from the feedback circuit when the circuit input signal is in the region near zero. When the input reaches 1% of the full scale input on the way up the circuit switches to a square root characteristic as a result of the amplifier U1 opening the switches Q1 and Q3. The remainder of the characteristic as the input goes up, as is shown in FIG. 3, to follow the square root characteristic. As the input signal decreases toward zero and comes in the region below 1% of the full scale input, then the operational amplifier again is converted to a linear amplifier by the closing of the switches Q1 and Q3. The path of the characteristic as the input decreases is, however, different a shown in FIG. 3, due to the effect of the feedback circuit on U1 which changes the bias on the input when operating in that direction. It will be noted that the value of the output, shown in FIG. 3, for an input of 1v. is 1.8705. This is because the output is equal to the square root of 3.5 times the square root of the input.

The circuit described is, of course, only one form of this invention. Variations of this circuit may be made while still utilizing the present invention.

The circuit elements of FIGS. 1A and 1B can be of the following type and have the following values:

| | |
|---|---|
| R1-1 M | R21-520K |
| R2-180K | R22-150-330K |
| R3-470K | R23-100K |
| R4-1 M | R24-470K |
| R5-4K | R25-470K |

-continued

| | |
|---|---|
| R6-100K | R26-100K |
| R7-500K | R27-355K |
| R8-1 M | R28-330K |
| R9-500K | R29-260K |
| R10-500K | R30-68K |
| R11-12K | R32-390K |
| R12-200-400K | R34-1 M |
| R13-200-400K | R35-200K |
| R14-4.7K | R36-1.3K |
| R16-300K | R38-100K |
| R17-12K | R39-200K |
| R18-200K | R40-100K |
| R19-200-400K | R41-200K |
| R20-200-400K | R42-188K |
| | R43-1 M |
| U1-7611 | U6-7611 |
| U2-7611 | U7-7611 |
| U3-7611 | U8-7510 |
| U4-7611 | U9-OP32 |
| U5-7611 | C1-.039 microfarad |
| | C2-.1 microfarad |
| | C3-.01 microfarad |
| | C4-6800 picofarad |
| | C5-6800 picofarad |

What is claimed is:

1. A square root insertion circuit comprising:

an operational amplifier having an input for receiving a circuit input signal and having an output for producing a circuit output signal; and a squaring circuit connected in a negative feedback path between said output and said input and operative to cause said circuit output signal to be driven by said amplifier to a value directly related to the square root of said circuit input signal, said squaring circuit including:

a first ramp circuit operable in response to said circuit output signal to provide a voltage ramp whose slope is proportional to the circuit output signal, circuit means for establishing the duration of said rap so that said duration is proportional to said circuit output signal to produce a peak value for said ramp voltage proportional to the square of the circuit output signal, and means for sampling said peak voltage and supplying it as an input to said amplifier from the negative feedback path.

2. A square root insertion circuit having an input for receiving a variable input signal and an output for producing an output signal of magnitude equal to the square root of said input signal during repetitive operating cycles consisting of a measurement and reset phase, comprising:

an operational amplifier having an input for receiving the insertion circuit input signal and having an output for producing the insertion circuit output signal;

a negative feedback path for said amplifier including a squaring circuit operable to cause said insertion circuit output signal to be directly related to the square root of said insertion circuit input signal;

said squaring circuit including:

a square wave oscillator circuit producing an output with a cyclic waveform for establishing said measurement phase and said reset phase of the operating cycle during alternate half cycles of the waveform, a first ramp circuit operable during the measurement phase to produce a first ramping voltage output which has a slope proportional to a signal at its input terminal, said first ramp circuit being resettable in response to the output of said oscillator circuit during said reset phase, a second ramp circuit operable during the measurement phase to provide a second ramping voltage output of predetermined fixed slope so that the magnitude of said second ramping voltage output is proportional to the time since the beginning of the measurement phase, said second ramp circuit being resettable in response to the output of said oscillator circuit during said reset phase, a comparator operable to compare said second ramping voltage output and the insertion circuit output signal and to produce a change of voltage level at the comparator output when the output of said second ramp circuit has reached the level of the insertion circuit output signal so that the time period between the start of the measurement phase and said change of voltage level is directly related to the magnitude of the insertion circuit output signal, a first switching means operable to connect the input of said first ramp circuit to the output of said operational amplifier during said time period and to disconnect said first ramp circuit from the output of said operational amplifier in response to said change in voltage level at the comparator output, so that said first ramping voltage output ramps only for said time period along a slope proportional to the magnitude of the insertion circuit output signal and is thus proportional to the square of said insertion circuit output signal, a sample and hold circuit operable to connect a capacitor across the output of said first ramp circuit at the end of said time period so that the magnitude of the output signal of said first ramp circuit is sampled when that magnitude is at its peak, said capacitor being connected as an input to the operational amplifier to complete the negative feedback path so that as the measurement phase is repeated and the sampled output signal of the first ramp circuit varies, the operational amplifier will force the insertion circuit output signal to take that value which will cause the input signal to the operational amplifier from the sample and hold circuit to be equal to the insertion circuit input signal, whereby the insertion circuit output signal is forced to take a value which is equal to the square root of said insertion circuit input signal, and means responsive to the half cycle of the oscillator output representing the reset phase of the operating cycle to reset said first and second ramp circuits.

3. A square root insertion circuit having an input for receiving a variable input signal and an output for producing an output signal of magnitude equal to the square root of said input signal during repetitive operating cycles consisting of a measurement and reset phase, comprising:

an operational amplifier having an input for receiving the insertion circuit input signal and having an output for producing the insertion circuit output signal;

a negative feedback path for said amplifier including a squaring circuit operable to cause said insertion circuit output signal to be directly related to the square root of said insertion circuit input signal;

said squaring circuit including a square wave oscillator circuit producing an output with a cyclic waveform for establishing said measurement phase and said reset phase of the operating cycle during alternate half cycles of the waveform, a first ramp circuit operable during the measurement phase to produce a first ramping voltage output which has a slope proportional to the signal at its input terminal, said first ramp circuit being resettable in response to the output of said oscillator circuit during said reset phase, a second ramp circuit operable during the measurement phase to provide a second ramping voltage output of predetermined fixed slope so that the magnitude of said second ramping voltage output is proportional to the time since the beginning of the measurement phase, said second ramp circuit being resettable in response to the output of said oscillator circuit during said reset phase, a comparator operable to compare said second ramping voltage output and the insertion circuit output signal and to produce a change of voltage level at the comparator output when the output of said second ramp circuit has reached the level of the insertion circuit output signal so that the time period between the start of the measurement phase and said change of voltage level is directly related to the magnitude of the insertion circuit output signal, a first switching means operable to connect the input of said first ramp circuit to the output of said operational amplifier during said time period and to disconnect said first ramp circuit from the output of said operational amplifier in response to said change in voltage level at the comparator output, so that said first ramping voltage output ramps only for said time period along a slope proportional to the magnitude of the insertion circuit output signal and is thus proportional to the square of said insertion circuit output signal, a sample and hold circuit operable to connect a capacitor across the output of said first ramp circuit at the end of said time period so that the magnitude of the output signal of said first ramp circuit is sampled when the magnitude is at its peak, said capacitor being connected as an input to the operational amplifier to complete the negative feedback path so that as the measurement phase is repeated and the sampled output signal of the first ramp circuit varies, the operational amplifier will force the insertion circuit output signal to take that value which will cause the input signal to the operational amplifier from the sample and hold circuit to be equal to the insertion circuit input signal, whereby the insertion circuit output signal is forced to take a value which is equal to the square root of said insertion circuit input signal, and means responsive to the half cycle of the oscillator output representing the reset phase of the operating cycle to reset said first and second ramp circuits;

another negative feedback path having a resistor, and a second switching means connected in said other feedback path with said resistor and operable when closed to complete said other negative feedback path for said operational amplifier;

means operable when the insertion circuit input signal is decreasing to close said second switching means at that certain level near zero where the noise in the input signal is likely to be of sufficient magnitude to cause the switch to oscillate between the open and closed state and operable to open said second switching means at a slightly higher level when the circuit input signal is increasing so that said amplifier will operate as a linear amplifier when said second switching means is closed; and a third switching means operable simultaneously with said second switching means to short out said capacitor of said sample and hold circuit to prevent feedback from said first ramp circuit.

* * * * *